US008596235B2

(12) United States Patent
Arnold et al.

(10) Patent No.: US 8,596,235 B2
(45) Date of Patent: Dec. 3, 2013

(54) VALVE DRIVE FOR ACTIVATION OF GAS EXCHANGE VALVES OF INTERNAL COMBUSTION ENGINES

(75) Inventors: Thomas Arnold, Stollberg (DE); Andreas Werler, Zwickau (DE); Joerg Wutzler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 298 days.

(21) Appl. No.: 12/931,091

(22) Filed: Jan. 24, 2011

(65) Prior Publication Data

US 2011/0180029 A1 Jul. 28, 2011

(30) Foreign Application Priority Data

Jan. 25, 2010 (DE) ..... 10 2010 005 790

(51) Int. Cl.
*F01L 1/34* (2006.01)

(52) U.S. Cl.
USPC ..... 123/90.17; 123/90.16; 123/90.18

(58) Field of Classification Search
USPC ..... 123/90.18, 90.6
See application file for complete search history.

(56) References Cited

U.S. PATENT DOCUMENTS

| | | | | |
|---|---|---|---|---|
| 4,448,156 | A * | 5/1984 | Henault | 123/90.17 |
| 5,253,622 | A * | 10/1993 | Bornstein et al. | 123/90.17 |
| 5,289,806 | A * | 3/1994 | Hurr | 123/90.17 |
| 5,359,970 | A * | 11/1994 | Krebs | 123/90.17 |
| 5,924,334 | A * | 7/1999 | Hara et al. | 74/568 R |
| 6,216,654 | B1 * | 4/2001 | Regueiro | 123/90.15 |
| 6,425,359 | B2 * | 7/2002 | Fujii et al. | 123/90.18 |
| 7,409,938 | B2 * | 8/2008 | Dengler | 123/90.18 |
| 8,082,895 | B2 * | 12/2011 | Yamada et al. | 123/90.16 |
| 8,225,759 | B2 * | 7/2012 | Wutzler et al. | 123/90.16 |
| 8,291,877 | B2 * | 10/2012 | Meintschel et al. | 123/90.18 |
| 8,297,247 | B2 * | 10/2012 | Schoeneberg et al. | 123/90.18 |
| 2010/0139594 | A1 * | 6/2010 | Wutzler et al. | 123/90.17 |
| 2011/0180029 | A1 * | 7/2011 | Arnold et al. | 123/90.17 |

FOREIGN PATENT DOCUMENTS

| | | |
|---|---|---|
| DE | 35 20 859 | 12/1986 |
| DE | 42 30 877 | 4/1993 |
| DE | 195 19 048 | 11/1996 |
| DE | 195 20 117 | 12/1996 |

(Continued)

OTHER PUBLICATIONS

Paper entitled, "Attachment for the Information Disclosure Statement" discussing each prior art reference.

*Primary Examiner* — Thomas Denion
*Assistant Examiner* — Steven D Shipe
(74) *Attorney, Agent, or Firm* — Collard & Roe, P.C.

(57) ABSTRACT

A variable valve drive for internal combustion engines is used for activation of gas exchange valves, in which the gas exchange valves engage different cam profiles of a camshaft driven by the crankshaft of the internal combustion engine. The camshaft has at least one displaceable cam segment that carries multiple different cam profiles having the same base circle section. Each one of the cam profiles is switched to be active for the related gas exchange valve, in accordance with the axial position of the cam segment relative to at least one related gas exchange valve. The axial positioning of the cam segment takes place by a setting shaft that can be rotated and is disposed parallel and next to the camshaft. The setting shaft has a guide track in which a tappet is guided, which acts on a transfer element that determines the axial position of the cam segment.

8 Claims, 2 Drawing Sheets

(56) References Cited

FOREIGN PATENT DOCUMENTS

| | | | | | |
|---|---|---|---|---|---|
| DE | 100 54 623 | | | 5/2002 | |
| DE | 10241920 | A1 | * | 3/2004 | ..... F01L 1/04 |
| DE | 10 2004 033 798 | | | 2/2006 | |
| DE | 10 2004 055 852 | | | 4/2006 | |
| DE | 102004055852 | A1 | * | 4/2006 | |
| DE | 10 2007 048 915 | | | 4/2009 | |
| DE | 102007061353 | | * | 6/2009 | |
| DE | 102007061353 | A1 | * | 6/2009 | ..... F01L 13/00 |
| DE | 102008061440 | | * | 6/2010 | |
| DE | 102008061440 | B3 | * | 6/2010 | ..... F01L 13/00 |

* cited by examiner

VALVE DRIVE FOR ACTIVATION OF GAS EXCHANGE VALVES OF INTERNAL COMBUSTION ENGINES

CROSS REFERENCE TO RELATED APPLICATIONS

Applicants claims priority under 35 U.S.C. §119 of German Application No. 10 2010 005 790 filed Jan. 25, 2010, the disclosure of which is incorporated by reference.

BACKGROUND OF THE INVENTION

1. Field of the Invention

The invention relates to a valve drive for activation of gas exchange valves of internal combustion engines, in which the gas exchange valves can engage different cam profiles of a camshaft driven by the crankshaft of the internal combustion engine, in switchable manner, directly or by way of additional transfer elements. The camshaft has at least one displaceable cam segment that has multiple different cam profiles having the same base circle section. Each of the cam profiles can be switched to be active for a related gas exchange valve(s), in accordance with the axial position of the cam segment relative to at least one related gas exchange valve.

2. The Prior Art

It is known to operate gas exchange valves of an internal combustion engine variably with different opening and closing time points, as well as with different valve opening strokes. Such a valve control is described in German Patent Application No. DE 42 30 877 A1. In this connection, a camshaft block having two different cam contours is disposed on a camshaft so as to rotate with it, but in an axially displaceable manner. Depending on the axial position of the cam block, a cam contour is connected with the stroke valve, by way of an intermediate element (transfer lever). The axial displacement of the cam block for changing the valve parameters takes place during the base circle phase, counter to the effect of a reset spring, by means of a pressure ring.

German Patent Application No. DE 35 20 859 A1 describes an internal combustion engine having at least one camshaft driven by a crankshaft, for activation of inlet and outlet valves. Two cams having different structures, in terms of their cam contour, and placed directly next to one another, are disposed on the camshaft. These cams determine the opening and closing time point and the opening stroke in accordance with their configuration, taking the valve play into account. During passage through the cam base circle, which has the same shape in both cams, an adjustable intermediate piece is displaced, by way of a shift rod and a lever, in such a manner that optionally, one of the two cams can be brought into a functional connection with the valve.

German Patent Application No. DE 195 19 048 A1 describes a variable valve drive for an internal combustion engine, in which again, two cams having different cam contours and placed directly next to one another are disposed on the camshaft. The change in cam engagement takes place via axial displacement of the camshaft with the cam situated on it.

Furthermore, a valve drive of an internal combustion engine is described in DE 195 20 117 C2, in which an axially displaceable cam block having at least two different cam paths is disposed on the camshaft, so as to rotate with it. The adjustment of the cam block takes place by way of an adjustment organ that is guided in the interior of the camshaft. The adjustment organ is displaced in the interior of the camshaft by means of a dual-action hydraulic or pneumatic piston/cylinder unit disposed on the face side of the camshaft. The adjustment organ is connected with an entrainment piece that penetrates an oblong hole disposed axially in the camshaft, and ends in a bore of the cam block.

German Patent Application No. DE 100 54 623 A1 describes a device for switching over a cam package on a camshaft, to activate gas exchange valves, in which device the cam package is guided on the camshaft in an axially displaceable manner. The gas exchange valve is in a functional connection with different cam contours, in accordance with the position of the cam package. The adjustment of the cam package takes place by way of a setting element in interaction with a gate track. In this connection, the setting element is a pin that can be displaced radially to the outside, which interacts, in the moved-out state, with at least two gate tracks formed in a guide part disposed around the cam package by approximately 180°.

A disadvantage of these devices is the great need for construction space that is required to adjust the cam block. These solutions can therefore be used only in the case of relatively large cylinder distances, so that the corresponding components can be accommodated. Another disadvantage is the great mass forces that occur during the setting process, which are required for displacing the cam blocks or the adjustment organs. Switching to a corresponding cam contour can generally take place only cylinder-selectively with the solutions named in the prior art. Valve-selective switching is not possible.

A significant disadvantage of the device of DE 100 54 623 A1 is that in order to switch to a different cam contour, the pin has to be moved out of the camshaft and tracked into an axially displaceable shift gate. After the switching process, the pin has to be moved back in again. This design is very parts-intensive and production-intensive, and there is the risk of damage to the camshaft resulting from incorrect shifting of the pin. A further disadvantage is that the engine speed of rotation is limited because of the required adjustment time of the pin. Furthermore, the adjustment is dependent on the oil pressure that is present.

German Patent Application No. DE 10 2004 033 798 A1 describes a valve stroke switching mechanism for gas exchange valves in an internal combustion engine, between two different cam contours, by means of a shift gate disposed on the housing of the internal combustion engine so as not to rotate, but in axially displaceable manner. The shift gate partly surrounds the camshaft and is provided with a gate groove that widens opposite to the direction of rotation of the camshaft. The side walls the groove each form a gate flank that can be brought reciprocally into a functional connection with a contact surface disposed on an axially displaceable second cam contour, on both sides, laterally, in order to switch the valve stroke. During valve stroke switching, the axially displaceable second cam contour is either pushed over the cam contour of the cam that is firmly connected with the camshaft, by the shift gate, or pushed away from the cam contour, so that optionally, two different cam contours can be brought into a functional connection with the gas exchange valve.

SUMMARY OF THE INVENTION

It is therefore an object of the invention to provide a valve drive of the type stated, for activation of gas exchange valves of internal combustion engines, with which a small construction size is achieved with little technical effort, and which avoids incorrect switching and damage to the camshaft during valve stroke switching, even at high engine speeds of rotation.

This object is accomplished by a variable valve drive in which the axial positioning of the cam segment relative to the gas exchange valve takes place via a setting shaft that can be rotated and is disposed parallel and adjacent the cam shaft. The setting shaft has a guide track in which a tappet is guided, which acts on a transfer element that determines the axial position of the cam segment and is directly connected with this segment.

The variable valve drive for internal combustion engines for activation of gas exchange valves is configured in such a manner that the gas exchange valves can engage different cam profiles of a camshaft driven by a crankshaft of the internal combustion engine, directly or by way of further transfer elements, in a switchable manner.

The camshaft has at least one displaceable cam segment that has multiple different cam profiles having the same base circle section, in at least one cam package, so that one of the cam profiles can be switched to be active for the related gas exchange valve(s), in accordance with the axial position of the cam segment relative to at least one related gas exchange valve. In this connection, the cam segment can carry one or more cam packages, and at least two different cam profiles within a cam package can be switched to be active for one or more gas exchange valves. One of the cam profiles can be a profile without elevation, to implement a valve shutoff. It is advantageous, according to the invention, if the axial positioning of the cam segments relative to at least one gas exchange valve that can be activated by the cams takes place via an adjustment shaft that can be rotated and is disposed parallel and next to the camshaft, and has a guide track in which a tappet is guided, which acts on a transfer element that determines the axial position of the cam segment and is directly connected with the cam segment. The direct connection of the transfer element with the cam segment allows axial displacement of the cam segment by the tappet and transfer element without additional intermediate elements. Direct displacement of the cam segment takes place with the rotation of the adjustment shaft, by way of the tappet and the transfer element. No other transfer elements on the camshaft or gate guides known from the state of the art, for contact of switching elements that rotate with the camshaft, are required. In this connection, the adjustment of the tappet takes place on the basis of the pitch of the guide track in which the tappet is guided, with its axial position being determined. The guide track has two axial stops between which the tappet is guided, whereby the guide track can be in one piece or consists of two separate contact contours that are, however, determined in their position relative to one another, and lie opposite one another. In an alternative embodiment, the stop contours can be configured to be spaced apart from the tappet, and can be brought into contact only for the switching process, in the axial switching direction. For relative positioning, a catch is then provided on the slide bearing or on the cam segment, which catch holds the cam segment or the slide bearing in its position. In accordance with the switching levels to be implemented, here, for example, for a three-level switching system, a corresponding number of catches (three) has to be provided. The cam segment or the slide bearing is then moved between each of the shift levels, by means of the tappet, and the axial positioning takes place by means of the catches. In an advantageous embodiment, the catch levels are structured to be self-centering, and a spring-loaded catch ball engages into a corresponding opposite recess, for example.

In a preferred embodiment, the transfer element is a bearing that is axially displaceable in a housing part of the internal combustion engine, in which bearing the cam segment is mounted so as to rotate. In this connection, the cam segment is simultaneously guided axially, so that the position of the displaceable bearing also determines the position of the cam segment. The adjustment of the axial position on the bearing of the cam segment allows engagement of the setting shaft only with the interposition of the tappet and of the displaceable bearing. This simultaneously allows mounting and axial positioning of the cam segment. Direct engagement on the bearing by way of the setting shaft and the tappet allows a low construction height, since it is possible to do without additional transfer elements, and with the bearing, a component is being utilized that takes on a bearing function and an axial adjustment function, in optimal manner, in terms of construction space, encircling the shaft. Furthermore, utilization of the slide bearing is advantageous, because a component that is also present in a cylinder head design without switchable valve stroke heights is used for applying the axial adjustment activation, and thus no additional construction space is required. It is advantageous, according to the invention, that the adjustment force is transferred to the cam segment by way of the displaceable bearing, in the axial direction. For this purpose, the bearing is configured in such a manner that it can transfer axial forces in addition to radial mounting of the cam segment.

In an advantageous embodiment, the cam segment is a cam sleeve, which is mounted on the camshaft so as to rotate with it but be axially displaceable. A possible embodiment is mounting it on a toothed shaft having a corresponding counter-contour on the inside circumference of the cam sleeve. Other alternatives are a cam segment that can be divided, which is firmly connected with a part that represents the base circle of the cam package, and whose cam-side embodiment is configured as an element that is divided in the axial direction and can be displaced relative to the base circle segment. Another alternative embodiment is a camshaft composed of cam segments, in which the cam segments are displaceable relative to one another, but the camshaft is formed by cam segments that are mounted in one another, so as to rotate with one another, without a camshaft pipe that transfers a continuous torque being present.

It is advantageous, according to the invention, if the tappet is a ball that engages into the guide track of the setting shaft and mounted on the outside circumference of the transfer element. In this connection, the guide track on the setting shaft has a configuration that is inclined relative to the axial expanse, so that when the setting shaft is rotated, an axial displacement of the ball mounted in the guide track takes place, since this ball is guided, in a fixed location, in a recess on the outside circumference of the transfer element that is mounted on the housing so as to rotate with it. The use of a ball as a tappet proves to be advantageous because of the self-centering and the low friction forces during adjustment. In an alternative embodiment, the transfer element is a pin that is connected with the displaceable bearing and engages into the guide track of the setting shaft. Alternatively, the guide track can also be formed from two contours, which enclose axial contact surfaces that are configured to lie opposite one another on the bearing.

According to the invention, the guide track is structured to be circumferential on the setting shaft and closed in itself, so that back and forth switching can be implemented with one direction of rotation of the setting shaft. Cylinder-selective switching that takes place one after the other for different cylinders can be implemented by means of the position of the guide tracks relative to one another. Alternatively, an actuator must be provided for a guide track that is not closed in itself, which actuator can turn the setting shaft axially in both directions.

According to the invention, the cam segment has two cam packages having different stroke curves. In this connection, each cam package is assigned to a gas exchange valve. In this way, two gas exchange valves can be switched by means of one cam segment.

It is advantageous if the actuator that activates the setting shaft is synchronized with the position of the camshaft. In this connection, the actuator is configured in such a manner that it can rotate the setting shaft about a defined angle position, step by step, so that an adjustment of the gas exchange valves takes place in cylinder-selective manner. Synchronization relative to the camshaft is required because a switching process can only take place in the base circle phase of the actuator. Rotation of the setting shaft synchronized with the rotation of the camshaft allows initiation and completion of the switching movement in the base circle phase of the cam. In this connection, in one embodiment, the actuator can be mechanically coupled with the camshaft part of the time. For mechanical coupling of the camshaft with the adjustment shaft, it is advantageous if a setting gear mechanism/step switching gear mechanism is provided, according to the invention. This allows synchronized switching of the cam profiles, driven by the camshaft.

For activation of the valve stroke switching, a camshaft is connected with and separated from a setting shaft that is disposed parallel to the camshaft, by way of a switchable setting gear mechanism, so that the setting shaft is rotated by the camshaft when an active engagement with it is produced, thereby axially displacing a cam package provided with different cam profiles on the camshaft, by way of tappet and a transfer element. The setting gear mechanism according to the invention, for connecting and separating the camshaft and the setting shaft, consists of a one-arm or multi-arm lever system and a profiled gate part. In this connection, in a possible embodiment, the one-arm or multi-arm lever system is firmly disposed on the setting shaft, and the profiled gate part is disposed on the camshaft so as to rotate with it and be axially displaceable. The profiled gate part can engage the lever system and be separated from it in a switchable manner, by an actuator.

In an alternative embodiment, the one-arm or multi-arm lever system is disposed on the camshaft in an axially displaceable manner, so as to rotate with it, and the profiled gate part is firmly disposed on the setting shaft. The lever system can engage the profiled gate part, and be separated from it, by means of an actuator, in a switchable manner.

The advantage of the present invention is that reliable valve stroke switching between different cam contours takes place with little effort and little required construction space. Because of the controlled rotation of the adjustment shaft by way of the camshaft, and thus the compulsorily controlled displacement of the transfer element, which is preferably configured as a slide bearing, incorrect switching positions during valve stroke switching are avoided. Another advantage is that valve switching between two or more cam profiles can be carried out with the solution according to the invention.

Because of the fact that the elements of the setting gear mechanism are configured as a gate part and lever system, gradual engagement of the gear mechanism elements with one another takes place during a switching process. As a result, switching surges and short-term peak forces that occur in the setting gear mechanism are avoided.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
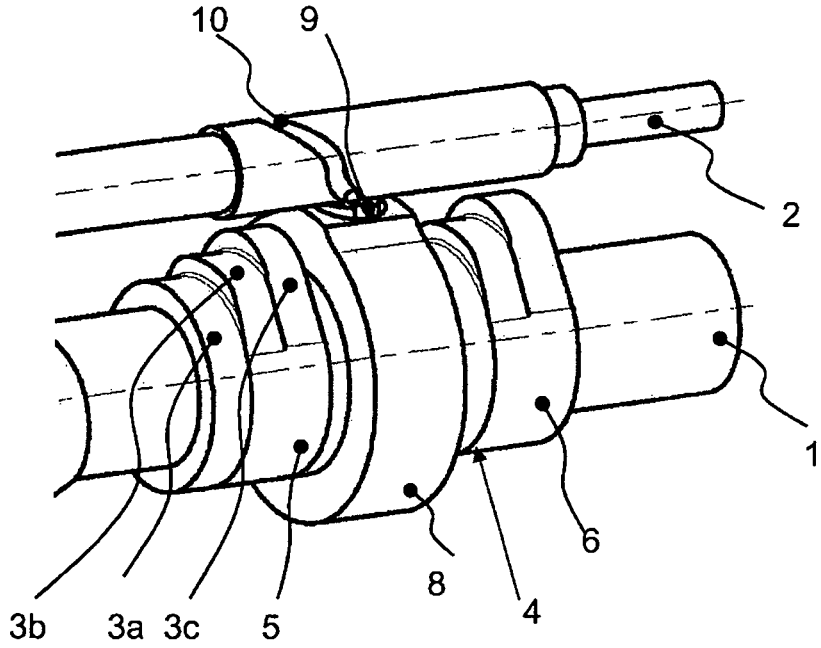
FIG. 1 shows a perspective representation of the valve drive according to one embodiment of the invention.

The valve drive according to the invention shown in FIG. 1, for activation of gas exchange valves, consists of a camshaft 1 driven by a crankshaft of the internal combustion engine, with a setting shaft 2 for activating valve stroke switching between different cam profiles 3*a*; 3*b* and 3*c* disposed parallel to it. In the embodiment shown, adjustment of two valves of a cylinder, not shown; takes place. An application of the solution according to the invention can be used analogously also for multiple cylinders. A cam segment 4 composed of two connected cam packages 5 and 6 is mounted on camshaft 1, so as to rotate with it and in axially displaceable manner. In the embodiment shown, cam packages 5 and 6 each consist of three adjacent cam profiles: a large cam profile 3*c*, a medium-size cam profile 3*b*, and a small cam profile 3*a*. It is also possible that cam package 5, 6 each consist of only two different cam profiles. In the embodiment shown, small cam profile 3*a* is a cam profile that rotates with the radius of the base circle, without any elevation, in order to implement valve shutoff in the axial position in which the cam profile 3*a* is active for the stroke valve. Cam segment 4 is structured as a sleeve connected with camshaft 1 so as to rotate with it, which sleeve is axially displaceable on camshaft 1. For switching, it is necessary for each of cam profiles 3*a*; 3*b* and 3*c* to be provided with a uniform base circle profile. For the axial displacement of cam segment 4, a transfer element configured as a slide bearing 8 is connected with cam segment 4, which element determines the axial position of cam segment 4 on camshaft 1 and thus the relative position of cam profiles 3*a, b, c*, with regard to the gas exchange valves activated by them. Slide bearing 8 has a tappet 9 structured as a ball here, which is guided in a guide track 10 of setting shaft 2. Because of guide track 10 that is structured to be inclined relative to axis A, axial displacement of slide bearing 8 takes place by rotation of setting shaft 2. Slide bearing 8 supports cam segment 4 in a rotatable manner, whereby the outer part of bearing 8, which displaceably supports tappet 9 in the housing of the internal combustion engine, here its cylinder head, is guided relative to camshaft 1, in a rotationally fixed manner.

Figure 2:
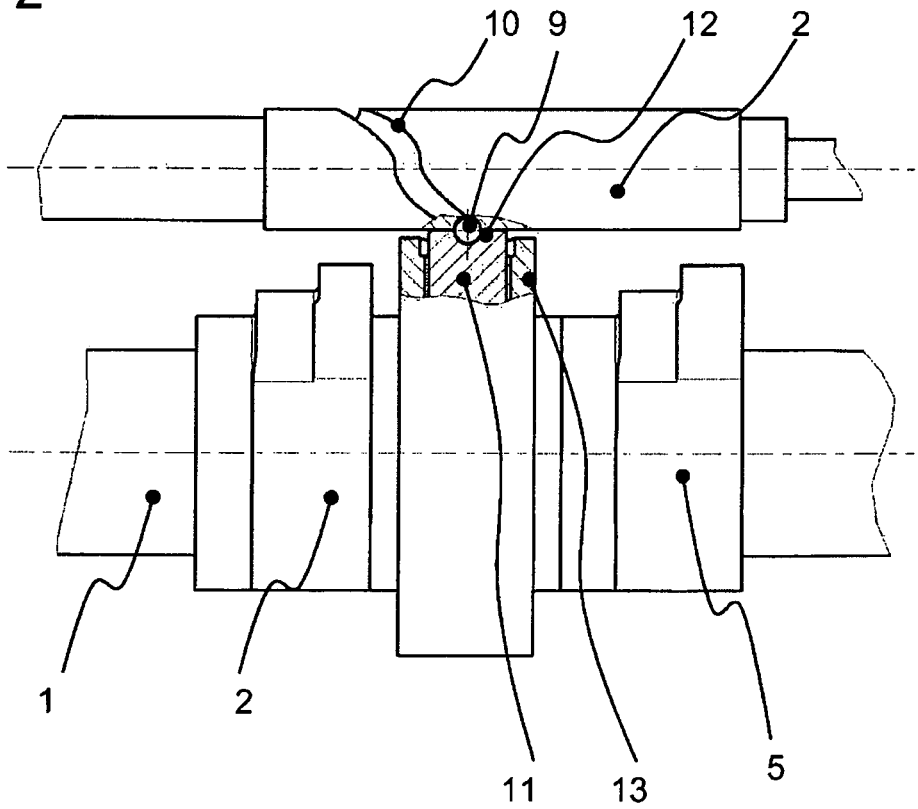
FIG. 2 shows a representation according to FIG. 1, partly in section.

FIG. 2 shows a representation of the valve drive according to FIG. 1, according to the invention, in partial section. Slide bearing 8 is shown in the region of the engagement of tappet 9, in partial section. An outer bearing ring 11, rotationally fixed in the housing of the internal combustion engine with regard to camshaft 1, but axially displaceable relative to it, has a hemispherical recess 12 in which tappet 9 is mounted. Tappet 9 engages into guide track 10 of setting shaft 2 on the side that lies opposite recess 12. Axial positioning of cam segment 4 takes place by rotating setting shaft 2, since slide bearing 8, and with it, the axially firmly connected cam segment 4, are displaced, guided by tappet 9. Slide bearing 8 has flank regions 13 that support themselves on bearing ring 11, in the axial direction of effect, which regions rotate with cam segment 4 and are connected with it not only axially but also in rotationally fixed manner, so that an axial switching force can be transferred to cam segment 4 by way of setting shaft 2, by way of tappet 9 and slide bearing 8. For valve stroke switching, camshaft 1 is connected with setting shaft 2, part of the time, for the switching process, by way of a switchable setting gear mechanism 7 that will be described in the following, in FIG. 3.

Figure 3:
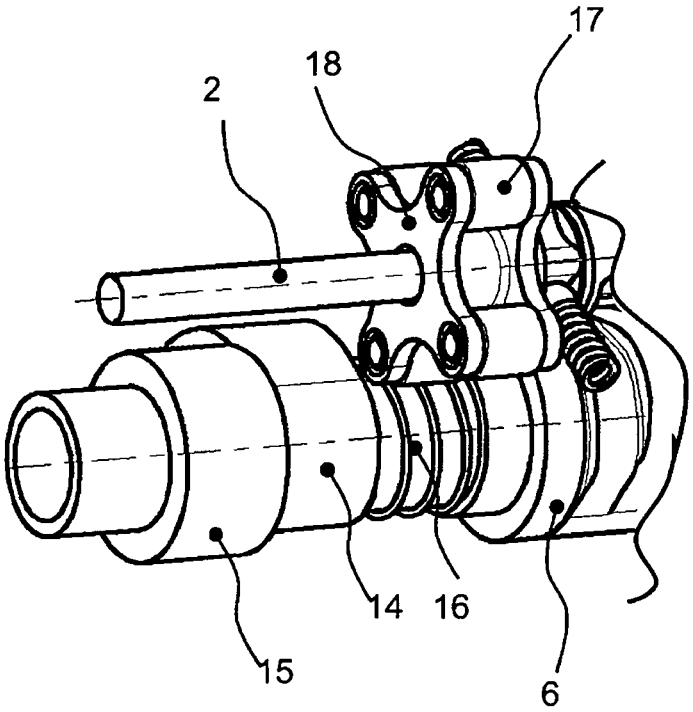
FIG. 3 shows a representation of the actuator of the setting gear mechanism.

In FIG. 3, a possible embodiment of the actuator, configured as a gear mechanism that switches step by step, is shown in a rest or catch position. In this position, no rotation of setting shaft 2 takes place, and thus also no switching of cam profiles 3*a, b, c* takes place. The gate part, which is preferably configured as a cam 14, is axially displaced by a slide actuator 15 on camshaft 1, to initiate switching to a different cam contour. Resetting of cam 14 into the rest or catch position is supported by means of a spring 16 that acts on the cam, or is undertaken by slide actuator 15 itself. To switch to a different cam profile, for example from the small cam profile having zero stroke 3*a* to the medium-size cam profile 3*b*, cam 14 is axially displaced on the camshaft 1, by activation of setting gear mechanism 7 by slide actuator 15, so that cam 14 comes into active engagement with a roller 17 of lever system 18. The rotational movement of camshaft 1 is transferred to adjustment shaft 2 by cam 14, which is connected with camshaft 1 in a rotationally fixed manner, when the cam engages into a lever of lever system 18. In the case of a lever system 18 configured to have four arms, lever system 18 and thus setting shaft 2 are rotated by 90°, by means of cam 14, in order to implement valve switching. Afterwards, the active connection between cam 14 and lever system 18 is separated, by slide actuator 15 and supported by the force of spring 16.

Accordingly, while only a few embodiments of the present invention have been shown and described, it is obvious that many changes and modifications may be made thereunto without departing from the spirit and scope of the invention.

LIST OF REFERENCE SYMBOLS USED

1 camshaft
2 setting shaft
3*a, b, c* stroke profiles
4 cam segment
5, 6 cam package
7 setting gear mechanism
8 slide bearing
9 tappet
10 guide track
11 outer bearing ring
12 recess
13 bearing flanks
14 cam
15 slide actuator
16 spring
17 roller
18 lever system

What is claimed is:

1. A variable valve drive for internal combustion engines, for activation of gas exchange valves, comprising:

a camshaft; and at least one axially displaceable cam segment mounted on the camshaft, said at least one axially displaceable cam segment having multiple different cam profiles, said cam profiles each having a same base circle section, wherein each one of said cam profiles is adapted to be switched to be active for at least one gas exchange valve, in accordance with an axial position of said at least one cam segment relative to said at least one related gas exchange valve;

a setting shaft that is adapted to be rotated and is disposed parallel and next to the camshaft for axial positioning of the cam segment relative to the at least one gas exchange valve by twisting of the setting shaft, said setting shaft having a guide track in which a tappet is guided; and a transfer element connected to the cam segment and on which the tappet acts, said transfer element determining an axial position of the cam segment, wherein the guide track is structured to run around a circumference of the setting shaft and to be closed in itself, so that back and forth switching can be implemented with one direction of rotation of the setting shaft.

2. The variable valve drive according to claim 1, wherein the transfer element is a bearing that is axially displaceable in a housing part of the internal combustion engine, and wherein the cam segment is axially guided and mounted so as to rotate in the bearing.

3. The variable valve drive according to claim 1, wherein the cam segment is a cam sleeve that is mounted on the camshaft in a rotationally fixed but axially displaceable manner.

4. The variable valve drive according to claim 1, wherein the tappet is a ball mounted on an outside circumference of the transfer element that engages into the guide track of the setting shaft, or is a pin that is connected with the transfer element and engages into the guide track of the setting shaft.

5. The valve drive according to claim 1, wherein the cam segment carries two cam packages having different stroke curves, wherein one cam profile of each of the cam packages is active for one gas exchange valve.

6. The valve drive according to claim 1, further comprising an actuator that is adapted to actuate the setting shaft, said actuator being synchronized with the position of the camshaft and rotating the setting shaft step by step about a defined angle position.

7. The valve drive according to claim 6, wherein the actuator consists of a stepper switching gear mechanism driven by the camshaft.

8. The valve drive according to claim 6, wherein the actuator consists of a lever system configured with multiple arms, said lever system being adapted to be displaced relative to a profiled gate part, and further comprising a slide actuator that is adapted to bring the cam into and out of engagement with the lever system.

* * * * *